US005083615A

United States Patent [19]

McLaughlin et al.

[11] Patent Number: 5,083,615

[45] Date of Patent: Jan. 28, 1992

[54] ALUMINUM ALKYLS USED TO CREATE MULTIPLE FRACTURES

[75] Inventors: Edward McLaughlin; F. Carl Knopf, both of Baton Rouge, La.

[73] Assignee: The Board of Supervisors of Louisiana State University and Agricultural and Mechanical College, Baton Rouge, La.

[21] Appl. No.: 471,105

[22] Filed: Jan. 26, 1990

[51] Int. Cl.[5] ..... E21B 43/263

[52] U.S. Cl. ..... 166/299; 166/308; 166/300; 166/63; 149/87

[58] Field of Search ..... 166/308, 299, 300, 63; 149/87

[56] References Cited

U.S. PATENT DOCUMENTS

| | | | |
|---|---|---|---|
| 2,676,662 | 4/1954 | Ritzmann | 166/299 |
| 2,765,329 | 10/1956 | Lindsey, Jr. | 149/87 |
| 3,134,437 | 5/1964 | Karpovich | 166/299 |
| 3,390,026 | 6/1968 | Cerych et al. | 149/87 |
| 3,578,516 | 5/1971 | Sanders | 149/87 |
| 3,634,049 | 1/1972 | Burns | 149/87 |
| 3,674,089 | 7/1972 | Moore | 166/299 |
| 3,788,907 | 1/1974 | Lehikoinen | 149/87 |
| 4,039,030 | 8/1977 | Godfrey et al. | 166/299 |
| 4,304,614 | 12/1981 | Walker et al. | 149/87 |
| 4,683,951 | 8/1987 | Pathak et al. | 166/299 |

OTHER PUBLICATIONS

Cuderman, J. F., and Northrop, D. A., A Propellant-Based Technology for Multiple-Fracturing Wellbores to Enhance Gas Recovery: Application and Results in Devonian Shale, SPE Production Engineering, Mar. 1986, pp. 97-103.

Watson, S. C., Benson, G. R. and Fillo, G. J., Liquid Propellant Stimulation: Case Studies in Shallow Appalachian Basin Wells, SPE Production Engineering, May 1986, pp. 203-212.

*Primary Examiner*—Ramon S. Britts
*Assistant Examiner*—Roger J. Schoeppel
*Attorney, Agent, or Firm*—William David Kiesel; Robert C. Tucker

[57] ABSTRACT

In a gas-generating chemical reaction carried out in a borehole that is largely filled with water, substantial pressure increases can be generated. This pressure can be used to fracture rocks around the borehole and, hence, stimulate water, oil or gas wells in tight rock formations. This pressure increase can also be used to fracture coal seams for enhanced in-situ gasification or methane recovery. This invention discloses the use of a new, novel system, based on the homogeneous reaction of aluminum alkyls with water, to create a controlled pressure increase. The most appropriate reaction mixture, as characterized by the rise of time of the generated pressure pulse and the energy content per unit length of borehole charge, is disclosed in this new invention.

6 Claims, 1 Drawing Sheet

ALUMINUM ALKYLS USED TO CREATE MULTIPLE FRACTURES

BACKGROUND OF THE DISCLOSURE

There are currently three technologies to stimulate water, oil and gas flow in a tight rock formation. These include: downhole explosives, propellant combustion and, the most frequently used, hydraulic fracturing. Each of these techniques has limitations. For example, with downhole explosives, the pressure rise is often too rapid, tending to create a zone of compact rock around the borehole which can actually decrease production. Hydraulic fracturing is characterized by a slow pressure rise which tends to create long single fractures parallel to existing natural fractures, often resulting in marginal stimulation. Propellant combustion, where propellant charges burned downhole are used to generate a high-pressure gas, produces the desired multiple fracture pattern, however the cost is high and the system remains contaminated with the propellant (generally nitrogen-based) until large volumes have flushed the borehole. These limitations can be overcome with the use of the novel new invention of this disclosure, chemical reaction-induced pressure pulses. Here, a gas-generating chemical reaction is carried out in a borehole that is largely filled with water and substantial pressure increases can be generated. This pressure can be used to fracture rocks around the borehole and, hence, stimulate water, oil and gas wells in tight rock formations. This pressure increase can also be used to fracture coal seams for enhanced in-situ gasification. This invention discloses the use of a new, novel system, based on the homogeneous reaction of aluminum alkyls with water, to create a controlled pressure increase. The most appropriate reaction mixture as characterized by the rise time of the generated pressure pulse and the energy content per unit length of borehole charge, is disclosed in this new, non-obvious invention.

Rock fracturing to stimulate water, oil or gas flow in a tight rock formation can be carried out by three methods. The first method is downhole explosives. In this case, an explosive charge is detonated in the hole. The highly concentrated stresses produced by such an explosion tend to create a zone of highly compacted rock around the borehole, a stress cage, and do not necessarily propagate fractures such that fluid flow is stimulated. In some cases, this method can damage the formation, resulting in a decreased production rate.

The second method is hydraulic fracturing. This is the chosen method of industry and is carried out by high pressure pumping of fluid with proppants into the rock formation. Normally, a single fracture is produced which is with or parallel to existing natural fractures, often resulting in marginal stimulation.

The third method is propellant combustion, a recent approach which uses propellant charges burned downhole to generate high pressure gas. The charges are tailored to provide a range of burning rates and can be used to produce a multiple fracture pattern. Fractures of this type are useful in linking natural formation fractures and increasing fluid flow to or from the borehole. However, the cost is high and groundwater would remain contaminated with the propellant (generally nitrogen-based) until large volumes of water have flushed the borehole.

In all three methods, the active system is confined to a specific region of the borehole, i.e. a region expected to produce. This isolation is accomplished by using hydraulic and mechanical packers, squeeze cementing and sundry other procedures.

The literature suggests that the pressure rise time, the time for 90% of the pressure rise to occur, is the important parameter in determining the fracture pattern. The longest pressure rise times are found in the second method, hydraulic fracturing, in which case a single long radial fracture is obtained. The shortest rise times are found when the first method, downhole explosives, is used, in which case compacted zones with few, if any, long radial fractures are created. The intermediate rise times, on the other hand, give the multiple fracture pattern, which consists of several radial fractures. With this in mind, it is apparent that in any new system developed, it is important to be able to control the rise time in order to control the fracture pattern. The new, novel present invention discloses a new rock fracturing system which has significant advantages over the three methods of current technology just discussed. This new, novel invention is one in which control of rise time can be readily effected. This disclosure uses chemical reaction-induced pressure pulses to stimulate water, oil and gas production.

In a closed space of fixed volume, a chemical reaction which produces heat and gas will increase the pressure of the system. A particular group of such reactions are those in which a material combines with water. These reactions can be divided into two broad categories, heterogeneous and homogeneous reactions.

The first category is heterogeneous solid/liquid reactions. The first type of reactions discussed involves metals of the Periodic Table, Groups I & II. The most common of these is probably sodium (Na), which reacts with water to produce hydrogen gas. In this case, the reaction is one between a solid and a liquid to produce solid sodium hydroxide and gaseous hydrogen, with sodium hydroxide tending to form a solid film around the sodium and hydrogen a gas film. These films have two significant effects, the first being buoyancy which is caused by the gas film, and the second being a diffusional resistance for the water moving through the film. This diffusion is the rate controlling process in the reaction so that rise time is probably predetermined by the diffusivities of the reacting species.

The second type of reactions in this category involves metal carbides. Many carbides of metals, particularly the salt-like carbides of metals in Periodic Table, Groups I, II & III, react readily with water to produce hydrocarbon gas. These materials may be divided into two main groups:

Carbides containing discrete atoms or $C^-$ ions and carbides which contain $C_2^{2-}$ ions. Carbides of the first group yield methane on hydrolysis. A typical example is aluminum carbide. Those of the second group yield acetylene and the most common example is calcium carbide. Again, the reactions which take place are between a solid and a liquid and diffusion rates of water through the gas and hydroxide films control the reaction rate and, thus, the pressure rise time. However, in both cases gas evolution is probably so vigorous that this film layer is constantly disturbed, so it should not be thought of as quiescent. The third type of reactions in this category involve other organometallics which are solids and show the same or similar reaction characteristics as those of the types above and will not be discussed further.

Solids of all three types may be passivated if these materials, on exposure to moist air, form oxide and/or insoluble hydroxide films. If these films are coherent and relatively nonporous, the "aged" materials may be unreactive unless the film is ruptured. Experiments in our laboratory with aluminum carbide show no reactivity with water unless the water was heated to 60° C.–100° C. This suggests that differential thermal expansion between unreacted aluminum carbide and the aluminum oxide/hydroxide film, both of which are water insoluble, caused rupture and exposure of fresh surface for reaction. These problems are not present in calcium carbide as the hydroxide formed in this case is water soluble.

With aluminum carbide, it was found that, even after heating the reactants to 100°. C. prior to reaction, the rate was too slow to be considered feasible for rock fracturing. The pressure rise time for this aluminum carbide reaction was found to be just under one hour. The slowed rate of this reaction is probably the result of diffusional resistance through the aluminum hydroxide/oxide film and the methane gas film. This is not a problem with this present disclosure's novel use of aluminum alkyls.

The second large category of reactions producing heat and gas that increase the pressure of the system discussed in this disclosure is Homogeneous Liquid/-Liquid Reactions. Many of the problems of reaction rate prediction and control associated with the heterogeneous solid/liquid reactions can be avoided in homogeneous liquid/liquid reactions. The most likely candidates in this category for gas producing agents are the aluminum alkyls of this disclosure, which are organometallic compounds of the general formula $A1R_3$, where R stands for a hydrocarbon radical. These compounds react violently with water to produce heat and the corresponding hydrocarbon gas. Some aluminum alkyls are available commercially in quantities as large as rail tank car amounts.

In the absence of oxygen, the aluminum alkyl reaction with water is shown in equation (1):

$$A1R_3+3H_2O \rightarrow A1(OH)_3+3RH \quad (1)$$

so that one mole of aluminum in this case produces three moles of hydrocarbon gas compared to the $A1_4C_3$ system in which four moles of aluminum are necessary to produce the same amount of gas. In this case, there are no diffusional resistance problems, and violence of the reaction keeps the two liquids in a well-mixed state. When examined in detail, the gas bubbles produced in these reactions actually increase the reaction rate via turbulent mixing of the reactants.

Most aluminum alkyls produced commercially have a small amount of hydrogen incorporated into them due to incomplete alkylation. Hence, small amounts of hydrogen will likely be formed upon hydrolysis.

This new, nonobvious invention disclosure proposes the gas generating reaction of aluminum alkyls with water as an alternative to these three current technology methods. Aluminum alkyls, such as triethylaluminum, cost on the order of one dollar/lb., and they are available in tank car deliveries. Therefore these aluminum alkyls are inexpensive when compared to the use of propellants. In addition, aluminum alkyls can release more energy per unit length of borehole than do propellants such as M5. Studies with propellants as gas generators have shown that the pressure rise time will control the fracture pattern. Aluminum alkyls such as triethylaluminum, TEA, and trimethylaluminum, TMA, are ideally suited for tailored pressure rise times. For example, aluminum alkyls can be easily diluted. Very slow rise times can be effected by dissolving the aluminum alkyls in a solvent not miscible with water, creating a multiphase reaction.

Chemical reaction-induced pressure pulses using aluminum alkyls represent an ideal low-cost stimulant. The energy content of aluminum alkyls is high and the reaction with water can be easily tailored to produce the optimum pressure rise times.

This new, novel invention disclosure uses aluminum alkyls as high pressure gas producing agents in gas fracturing technology. A review of the properties and reactions of aluminum alkyls, relevant to the generation of high pressure gases is presented here. Aluminum alkyls are produced in large quantities by several companies. Aluminum alkyls, AA, are highly reactive compounds. Their main use is as catalysts in the polymerization industry, however their high reactivity has captured the interest of researchers in many fields. AA compounds react vigorously with air and water, producing large quantities of heat and gas. Undiluted, they are pyrophoric in nature, igniting spontaneously in air, particularly the lower formula weight homologs, i.e. trimethylaluminum, TMA, and triethylaluminum, TEA.

All AA compounds react explosively with liquid water. The presence of air further intensifies this reaction. In reacting with oxygen, aluminum oxide is produced along with water and carbon dioxide as the major products. Reaction with water produces, as the major products, aluminum hydroxide and the corresponding hydrocarbon gas, which can ignite.

The focus of the present invention disclosure is on the reaction of aluminum alkyls with water in the absence of oxygen to produce hydrocarbon gases at elevated pressures. The organo-aluminum reactions most important are TMA and TEA with water.

Of interest is the fact that the liquid specific heat of AA compounds is about half that of water, and all react exothermically with water and air. A few AA compounds freeze at normal atmospheric conditions so that thawing must be accounted for in some facilities if ambient temperature falls below certain values.

In the TMA and TEA reactions with water, methane and ethane are produced respectively. The Virial equation of state can be used to predict the state variables for the methane and ethane produced in these reactions. The Virial equation is shown below as equation (2):

$$PV=RT(1+B/V^2+C/V^3+D/V+\ldots) \quad (2)$$

The first three virial coefficients for methane and ethane are available and should cover temperatures up to 623° K. and pressures to about 5000 psig. Below this temperature, all higher order terms can be neglected. Also, if excess water is used to adjust the initial gas volume of the reactions, solubility data for the methane/water system and the ethane/water system must be used to predict the final equilibrium conditions. Using this data, which is based on thermodynamic equilibrium, and by applying simplifying assumptions, the final pressures attained can be predicted and, by manipulating the initial gas volume, can be controlled.

Monitoring the pressure versus time response of constant volume reactions of AA compounds with water documents the dynamic characteristics of aluminum alkyl reactions with water. This response, known as the pressure rise time (time to achieve 90% of the final pressure), determines whether the reaction is considered to be an explosive or slower reaction.

Triethylaluminum, TEA, and Trimethylaluminum, TMA, are the most logical choices of material for development of a homogeneous downhole gas generating system. While the TMA reaction with water is more energetic than that of TEA, after considering the physical properties and cost of each, TEA is preferable. TMA is a solid below 59.5° F. and would be solid on a cold day. TEA melts at −49.9° F., a 100° F. difference. TMA is also currently ten times more expensive compared with TEA. Heats of reaction with water are substantial in both cases, with TMA at 2939 BTU/lbm and TEA at 1811 BTU/lbm, both at 77° F. A mixture of the two or even with other aluminum alkyls can be used to tailor the pressure rise time and expand the temperature range in which the system is a liquid. A further point is that critical properties of methane and ethane can be important at the conditions of a downhole pressure pulse. The critical temperature and pressure for $CH_4$ are −117° F. and 667 psi, while for $C_2H_6$ they are 90° F. and 708 psi.

If the energy available for fracturing using aluminum alkyls can be taken as the heat of reaction at room temperature, then a comparison can be made between TMA, TEA and propellants previously studied by the literature. Literature has proposed that the volume of rock which contains the fracture is proportional to the total energy released so that $$\pi R^2 L = BE$$

where:

R = radial length of the major fracture measured from the center of the borehole L = length of borehole section E = energy density of reactants (energy/volume)

B = proportionality constant that depends on the mechanics and structural properties of the formation For ash fall tuff rock formation, B = 0.193. Comparison for 6" diameter borehole, 1' long in ash fall tuff rock is given below to compare TMA and TEA with M5 propellant. This comparison assumes that the hole is filled per unit-length with the stoichiometric amount of water and aluminum alkyl.

Comparison of M5 Propellant with Aluminum Alkyls

| Material | (E/L)Btu/ft | R(ft) |
|---|---|---|
| M5 | 10,400 | 19.7 |
| TEA | 13,238 | 22.0 |
| TMA | 17,237 | 25.3 |

This data shows that, from values of the energy released per unit length (E/L), aluminum alkyls are better than the propellant.

To compare the various possible reactions of TEA with proton donors, the stoichiometric volume of reactants needed to produce one mole of hydrocarbon gas has been calculated for several candidate reactants. The minimum volume required was for the TEA/water system. The maximum volume is open-ended and would be attained by dilution of the TEA with an appropriate solvent. Table I summarizes these calculations.

TABLE I

Reaction of TEA with Various Reactants to produce one mole of Ethane

| Reactant | Total Volume (cm3) | Volume of TEA (cm3) | Volume of Reactant (cm3) |
|---|---|---|---|
| $H_2O$ | 63.6 | 45.5 | 18.1 |
| HF | 65.5 | 45.5 | 20.0 |
| $HNO_3$ | 87.2 | 45.5 | 41.7 |
| $H_2SO_4$ | 72.3 | 45.5 | 26.8 |
| HBr | 75.4 | 45.5 | 29.9 |

In studies on the use of propellants as gas generators, it was shown that pressure rise time controlled the fracture pattern. There is a need, therefore, in the gas generation system chosen, to be able to control this parameter in order to determine the fracture characteristics. This is obviously currently a choice between hydraulic and multiple fracture regimes, since explosive fracture is seldom desired for stimulation.

The nonobvious invention of this disclosure, use of aluminum alkyls such as TEA and TMA, is ideally suited for tailored pressure rise times. This can be effected in several ways.

The first way is by solvent dilution. The rate of reaction with water or alcohol, in the absence of oxygen, can be reduced significantly by dilution of the aluminum alkyl with an appropriate solvent. By controlling the rate of reaction, the pressure rise time is also controlled. The main drawback of this method is that the energy density of the system is also reduced.

The second way is by using different proton donors, thus replacing water with alcohols of varying chain length and/or steric hindrance. The use of less reactive proton donors can achieve the desired buffering effect also. In this case the rate is decreased due to an increased difficulty in obtaining protons. Also, the use of higher molecular weight proton donors decreases the molar concentration, hence the reaction rate decreases. Again, energy density is also decreased. The addition of an acid to any of the above systems would likely speed the reaction. For example, if the TEA/water system is not "fast" enough for a certain application, 5% by weight $H_2SO_4$ may be used to increase the rate. Some acids that may be used are Sulfuric ($H_2SO_4$), Nitric ($HNO_3$), Hydrobromic (HBr) and Hydrochloric (HCl) acids.

A third way is by using different aluminum alkyls. Different aluminum alkyls can exhibit different reaction dynamics. A fourth and final way is by using multiphase reactions. By using immiscible reactants, a diffusional resistance can be introduced. This interfacial type reaction can be controlled by varying parameters such as surface tension.

SUMMARY OF THE INVENTION

This invention is a gas-generating chemical reaction carried out in a borehole largely filled with water that generates substantial pressure increases. The nonobvious device of this invention provides a less expensive means than commercially currently available to gain a tailored pressure rise producing adequate fracturing downhole.

It is a principal object of this invention to provide desired multiple downhole fractures with a controlled pressure rise without high cost and without contaminating the groundwater.

Another object of this invention is to provide downhole fracturing for water and oil and gas wells that can be tailored to the degree necessary for adequate stimulation.

Still another object of this invention is to fracture coal seams for enhanced in-situ gasification or release of methane.

IN THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
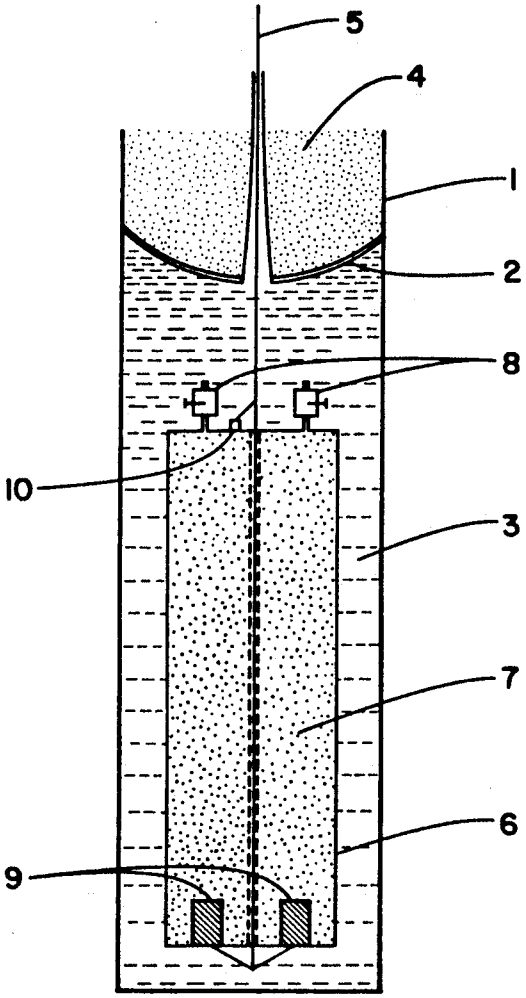
FIG. 1 is a cutaway view of a borehole in which has been placed a device which contains aluminum alkyl for reaction downhole.

In FIG. 1 is shown a device for placing the novel reaction chemistry of this disclosure downhole to produce the tailored pressure rises of this new invention. A borehole 1 is shown where a packer 2 has been placed downhole to separate sand 4 from the water 3 in the hole. The aluminum alkyl 7 is placed in the container 6 by means of the valves 8 and placed downhole at a selected depth. A thin control cable 5 to the surface is run through the packer 2 and attached to the container 6 containing the aluminum alkyl so that an electrical charge may be sent to the detonators 9. In addition a pressure transducer 10 has been attached to the container 6 to monitor pressure rise and is connected to the control cable 5.

Figure 2:
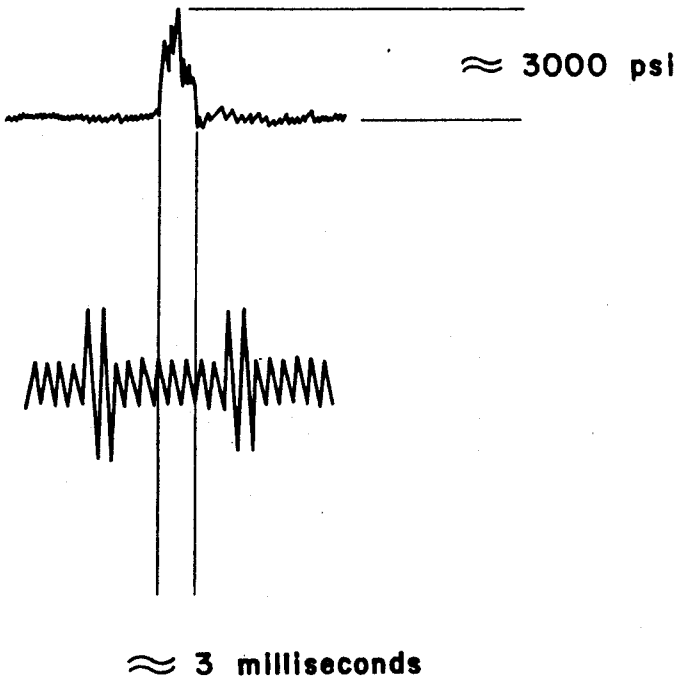
FIG. 2 is a graph of a substantial pressure rise associated with the reaction of an aluminum alkyl.

The electrical charge is sent by means of the control cable 5 and the detonators 9 fire allowing the aluminum alkyl 7 in the container 6 to contact the water 3 in the borehole 1. The reaction occurs rapidly and is monitored by the transducer 10. A typical pressure profile is shown in FIG. 2. A rapid pressure rise to over 3000 psi is shown to occur in only milliseconds. Such a substantial pressure rise in this rapid fashion is ideal to produce the adequate fracturing desired for stimulation of the formation. Additionally applying the controls described in this disclosure the pressure rise can be tailored for the downhole situation. The desired fracturing is done more inexpensively than current technology and produces no contamination of groundwater.

In order to determine the feasibility of the use of aluminum alkyls in a downhole, gas generating system, field experiments have been performed to document the reaction dynamics and energy densities of the aluminum alkyl reaction.

FIELD EXPERIMENTS

The reaction of aluminum alkyls with water in a wellbore will produce a pressurization in the borehole and result in multiple fractures. The pressure pulse can by used to stimulate groundwater, oil, and gas wells in tight rock formations.

In conjunction with the U.S. Army Waterways Experiment Station a field test of the reaction system of triethylaluminum and water was done at the Ft. Polk testing Range in Louisiana.

The experiments were performed as follows. First 3 gallons of TEA were transferred under nitrogen pressure to a 5 in. diameter by 7 ft. length stainless steel canister. The canister was then lowered into a 6 in. by 75 ft. deep borehole which was largerly filled with water. A sand stop and sand stamp were used to seal the borehole and give an approximate alkyl to water ratio of 1 to 3. The reaction was initiated by detonating a small PETN charge on the bottom of the canister to open it.

The data collected showed a pressure rise time of 1 millisecond, with a peak pressure of 3000 psi and a duration of 5 milliseconds. The pressure rise time indicates that the reaction is most likely in the multiple fracture regime.

Two 4 in. by 75 ft. vent holes, located 10 feet on either side of the borehole, were filled with water which was expelled during the reaction. It can be concluded that the fracture regime after reaction extended at least 10 ft. on either side of the borehole.

Whereas this invention has been described with respect to one embodiment thereof, it should be realized that various changes may be made without departing from the essential contributions to the art made by the teachings hereof.

I claim:

1. A method of producing chemical reaction-induced pressure pulses to stimulate water, oil or gas production from a well which contains a material that reacts with aluminum alkyl located in a section of a borehole of said well from which section it is desired to stimulate water, oil or gas production, which comprises:

(a) positioning a sealed container containing aluminum alkyl in said borehole within said section;

(b) diluting said material in said section with alcohol;

(c) puncturing said container in said section in a manner to expose said aluminum alkyl to said alcohol and said material.

2. A method of producing chemical reaction-induced pressure pulses to stimulate water, oil or gas production from a well which contains a material that reacts with aluminum alkyl located in a section of a borehole of said well from which section it is desired to stimulate water, oil or gas production, which comprises:

(a) positioning a sealed container containing a predetermined amount of aluminum alkyl in said borehole within said section; and (b) puncturing said container in a manner to allow said aluminum alkyl to react with said material at a rate to obtain a pre-determined pressure rise time greater than that which creates an explosive fracture regime.

3. A method according to claim 2 wherein said material is selected from a group consisting of water, or alcohol, or acid, or a combination of water and alcohol, or a combination of water and acid.

4. A method according to claim 3 wherein said acid is selected from a group consisting of sulfuric acid, nitric acid, hydrobromic acid, hydrochloric acid, or a combination thereof.

5. A method according to claim 2 or 3 wherein said aluminum alkyl is selected from a group consisting of triethylaluminum, trimethylaluminum, or a combination thereof.

6. A method according to claim 2 wherein said aluminum alkyl in said container has been dissolved in a water-immiscible solvent.

* * * * *